US007677142B1

(12) United States Patent
Cousin

(10) Patent No.: US 7,677,142 B1
(45) Date of Patent: Mar. 16, 2010

(54) PLIERS HAVING ERGONOMIC HANDLE

(76) Inventor: Michael G. Cousin, 12433 84th Way North, Largo, FL (US) 33773

( * ) Notice: Subject to any disclaimer, the term of this patent is extended or adjusted under 35 U.S.C. 154(b) by 0 days.

(21) Appl. No.: 11/868,100

(22) Filed: Oct. 5, 2007

(51) Int. Cl.
*B25B 7/00* (2006.01)

(52) U.S. Cl. ..... 81/427.5

(58) Field of Classification Search ..... 81/427.5, 81/415–418; 30/193, 186, 244; D8/52, 97
See application file for complete search history.

(56) References Cited

U.S. PATENT DOCUMENTS

| | | | | | |
|---|---|---|---|---|---|
| 146,829 | A | * | 1/1874 | Lindsay | 81/351 |
| 2,382,606 | A | * | 8/1945 | Clark | 81/356 |
| D142,867 | S | | 11/1945 | Johnson | |
| D142,888 | S | | 11/1945 | Miller | |
| D220,309 | S | | 3/1971 | Cutter | |
| D235,053 | S | | 5/1975 | Nockleby | |
| D253,088 | S | * | 10/1979 | Levin | D8/52 |
| D272,984 | S | | 3/1984 | Shaffer | |
| 4,753,011 | A | | 6/1988 | Long | |
| 4,934,222 | A | | 6/1990 | Rittmann et al. | |
| 4,947,553 | A | * | 8/1990 | Bendickson et al. | 30/262 |
| 5,020,399 | A | | 6/1991 | Annis et al. | |
| 5,279,034 | A | | 1/1994 | Smith et al. | |
| D343,779 | S | | 2/1994 | Imhoff | |
| D373,294 | S | | 9/1996 | Eggert et al. | |
| 5,609,080 | A | | 3/1997 | Flavigny | |
| 5,659,959 | A | | 8/1997 | Parlowski | |
| D386,375 | S | * | 11/1997 | Harris | D8/52 |
| D398,510 | S | | 9/1998 | Eggert et al. | |
| D420,886 | S | | 2/2000 | MacIntosh et al. | |
| 6,134,994 | A | | 10/2000 | Gomas | |
| 6,176,159 | B1 | | 1/2001 | Risse | |
| 6,234,050 | B1 | | 5/2001 | Konen et al. | |
| D470,734 | S | | 2/2003 | Budrow | |
| D511,951 | S | | 11/2005 | Sprouse | |
| D537,308 | S | | 2/2007 | Wang | |
| D537,309 | S | | 2/2007 | Wang | |
| D561,899 | S | * | 2/2008 | Golden | D8/52 |
| 2002/0023524 | A1 | | 2/2002 | Lowe et al. | |
| 2006/0123651 | A1 | | 6/2006 | Tillim | |
| 2006/0225538 | A1 | | 10/2006 | Brown | |

* cited by examiner

*Primary Examiner*—Hadi Shakeri
(74) *Attorney, Agent, or Firm*—Ronald E. Smith; Smith & Hopen, P.A.

(57) ABSTRACT

A hand-held tool includes first and second metallic parts pivotally interconnected to one another. A first cushioned hollow sleeve is adapted to receive the first handle and a second cushioned hollow sleeve is adapted to receive the second handle. The first sleeve is relatively straight and elongate and the second sleeve is arcuate and truncate in extent. A user holds the tool with the arcuate sleeve abutting the palm while grasping the straight sleeve with the fingers until the concentrated stress caused by the arcuate shape begins to produce fatigue. The tool is then rotated so that the arcuate sleeve is grasped by the fingers and the straight sleeve abuts the palm. The straight sleeve distributes the stress over a wider, less concentrated area. Continued rotation of the tool enables a user to employ it without fatigue for a prolonged period of time.

2 Claims, 8 Drawing Sheets

PLIERS HAVING ERGONOMIC HANDLE

BACKGROUND OF THE INVENTION

1. Field of the Invention

This invention relates, generally, to hand-held tools. More particularly, it relates to a hand-held tool with ergonomic handles that minimize fatigue.

2. Description of the Prior Art

U.S. Pat. No. 4,934,222 to Rittman and others patent discloses a first, short, curved handle and a second handle having two straight sections with a pronounced bend formed between the two straight sections.

The tool disclosed by Long in U.S. Pat. No. 4,753,011 has a concavity formed in the palm part thereof.

Annis and others, in U.S. Pat. No. 5,020,399, disclose a tool having one handle shorter than the other but the convex handle is the longer of the two.

None of the known tools have a structure that enables them to be held in two different ways where a first way concentrates stress on the palm of the hand along the base of the thumb and a second way spreads out the stress throughout the same area so that the palm of the hand along the base of the thumb is alternately stressed and relaxed as the tool is held in the two different ways.

Thus there is a need for such a tool so that the tool may be used for prolonged periods of time with minimal fatigue.

However, in view of the prior art taken as a whole at the time the present invention was made, it was not obvious to those of ordinary skill how the identified need could be fulfilled.

SUMMARY OF THE INVENTION

The long-standing but heretofore unfulfilled need for a hand-held tool that minimizes user fatigue is now met by a new, useful, and non-obvious invention.

The inventive structure is a hand-held tool having novel handles with an ergonomic shape to reduce the fatigue of the user. The tool is held in two (2) different ways for a predetermined amount of time in each way. When held in a first way, the stress imparted against a user's hand is slightly concentrated across the palm near the base of the thumb. When held a second way, the same stress is spread out over a larger surface area across the palm near the base of the thumb. Thus, most of the stress is applied to the same area of the palm, but first in a slightly more concentrated way and secondly in a more widely spread, distributed way. As the user switches between the two types of stress, each relieves the other and enables a user to continue use of the tool for extended periods of time without experiencing fatigue.

In a first configuration, a curved, convex handle rests in the palm of a user's hand at the base of the thumb. A relatively straight handle is grasped by the user's fingers.

In a second configuration, the relatively straight handle rests in the palm of the user's hand at the base of the thumb and the curved, convex handle is grasped by the user's fingers.

The curved, convex handle is shorter than the relatively straight handle. Accordingly, slightly more concentrated stress is applied to the user's palm when the tool is held in the first configuration, i.e., with the curved, convex handle resting in the palm of a user's hand at the base of the thumb and the relatively straight handle being grasped by the user's fingers.

Similarly, slightly less concentrated stress is applied to the user's palm when the tool is held in the second configuration, i.e., with the relatively straight handle being resting in the palm of the user's hand at the base of the thumb and the curved, convex handle being grasped by the user's fingers.

The tool head forms no part of the invention and the handles can be used on any pliers-like tool.

An important object of the invention is to provide a hand-held tool that enables a user to work with the tool over extended periods of time without fatigue or with minimal fatigue.

A closely related object is to provide a tool that alternately stresses and relaxes the palm of the user.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
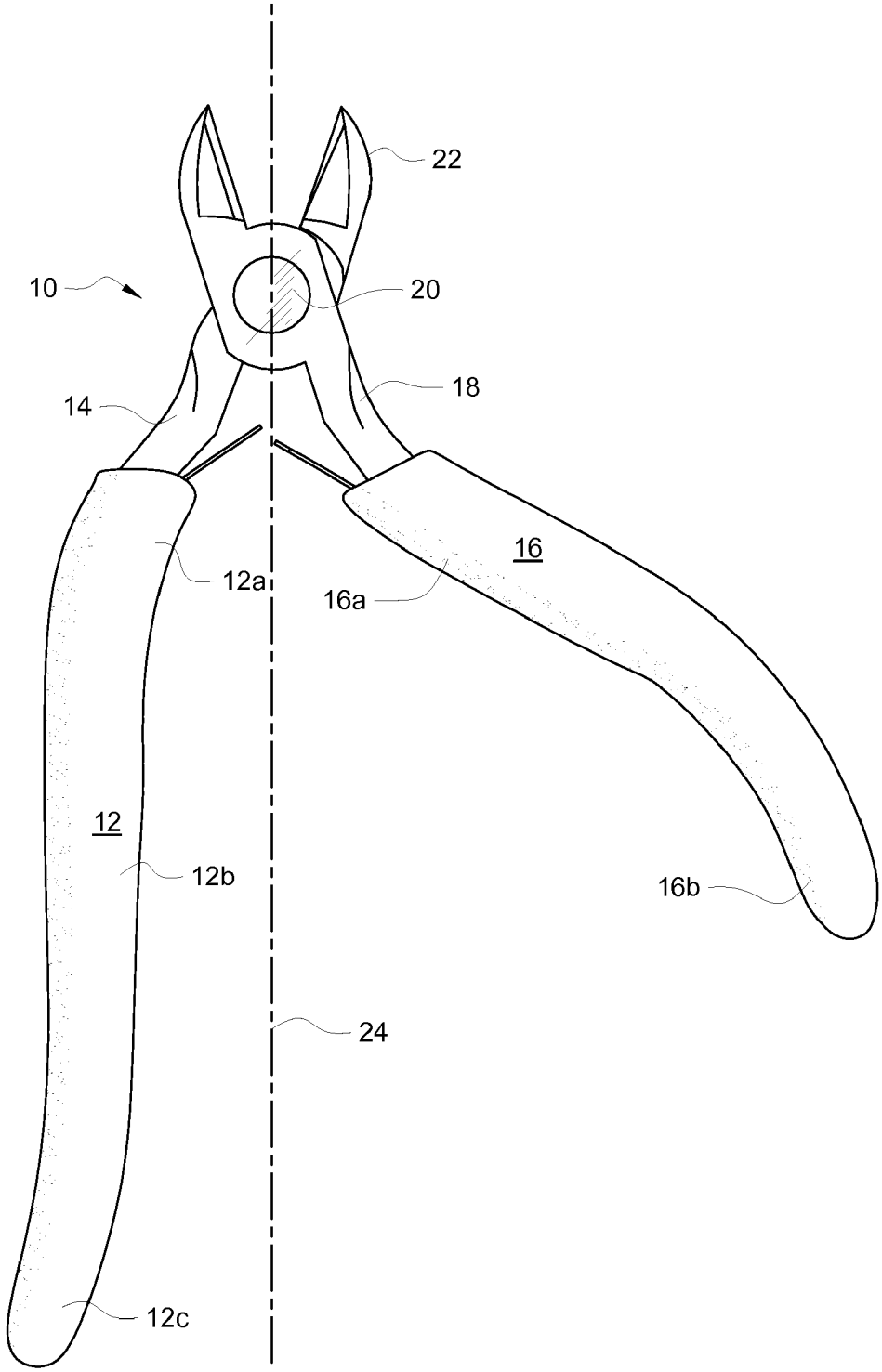
FIG. 1 is an elevational view of the novel handles when pivoted into a fully open configuration.
Figure 2:
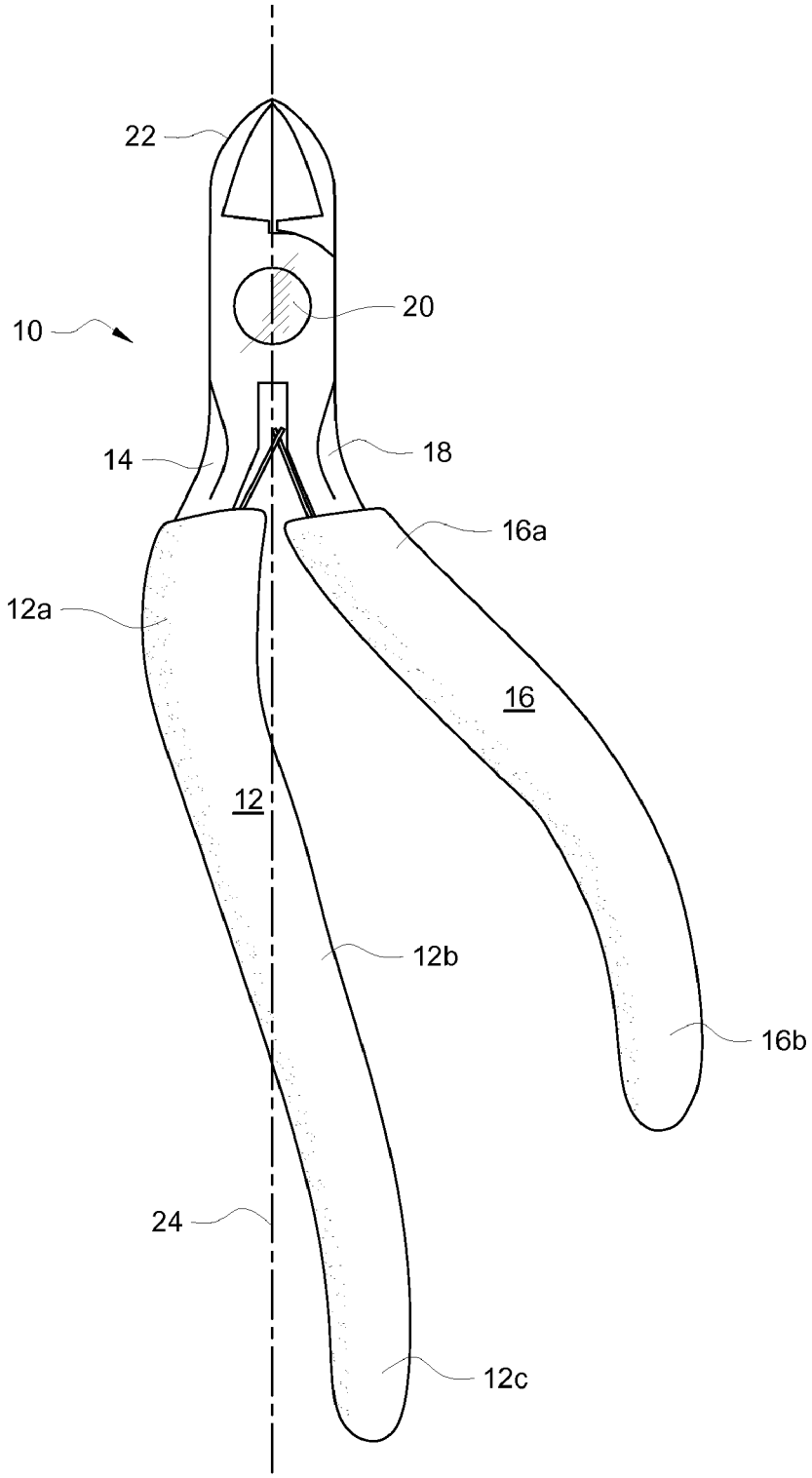
FIG. 2 is an elevational view of the handles when pivoted into a fully closed configuration.

Referring now to FIGS. 1 and 2, it will there be seen that an illustrative embodiment of the invention is denoted as a whole by the reference numeral 10.

Cushioned hollow sleeve 12 receives metallic handle 14 therein. Therefore, the shape of metallic handle 14 determines the shape of cushioned hollow sleeve 12.

Cushioned hollow sleeve 16 receives metallic handle 18 therein. Therefore, the shape of metallic handle 18 determines the shape of cushioned hollow sleeve 16.

Metallic handles 14 and 18 are pivotally interconnected to one another at pivot point 20. The part of each handle 14, 18 that is uncovered, i.e., head 22 of the tool, may be shaped into many different configurations so that the tool can perform many different functions. Accordingly, the shape of head 22 is irrelevant to this invention.

Reference is made to the respective shapes of cushioned sleeves 12 and 16 for convenience, it being understood that the respective shapes of the underlying metallic handles are the same.

Without reference to any particular head 22, a longitudinal axis 24 is drawn through pivot point 20 of said head to facilitate description of the physical structure of each sleeve 12, 16. From an inspection of FIG. 1 it is apparent that sleeve 16 is about two-thirds (⅔) the length of sleeve 12.

FIG. 1 depicts sleeves 12, 16 in their fully open position. Sleeve 12 upper section 12*a* is truncate and diverges at a slight angle, about ten degrees (10° away from longitudinal axis 24. Middle section 12*b* is elongate and is substantially parallel to said longitudinal axis. Sleeve 12 lower section 12*c* is truncate, having a length substantially equal to that of top section 12*a*, and diverges at a slight angle away from longitudinal axis 24, said angle being substantially the same angle at which top section 12*a* diverges from said longitudinal axis 24.

Sleeve 16 has only two (2) sections. Upper section 16*a* is substantially straight and diverges from longitudinal axis 24 at an angle of about forty five degrees (45°) when said sleeves are fully separated from one another as depicted in FIG. 1. Lower section 16*b* is arcuate and has a length substantially equal to the length of upper section 16*a*.

FIG. 2 depicts sleeves 12, 16 in their fully closed position. Sleeve 12 upper section 12*a* is now substantially parallel to axis 24, as is sleeve lower section 12*c*. Middle section 12*b* is disposed at a slight angle to said longitudinal axis and crosses it as depicted.

Upper section 16*a* of sleeve 16 diverges from longitudinal axis 24 at an angle of about thirty degrees (30°) when said sleeves are positioned at their smallest separation distance, i.e., when the opposed heads of the tool abut one another. The gradual bend formed in lower section 16*b* curves toward longitudinal axis 24.

Figure 3:
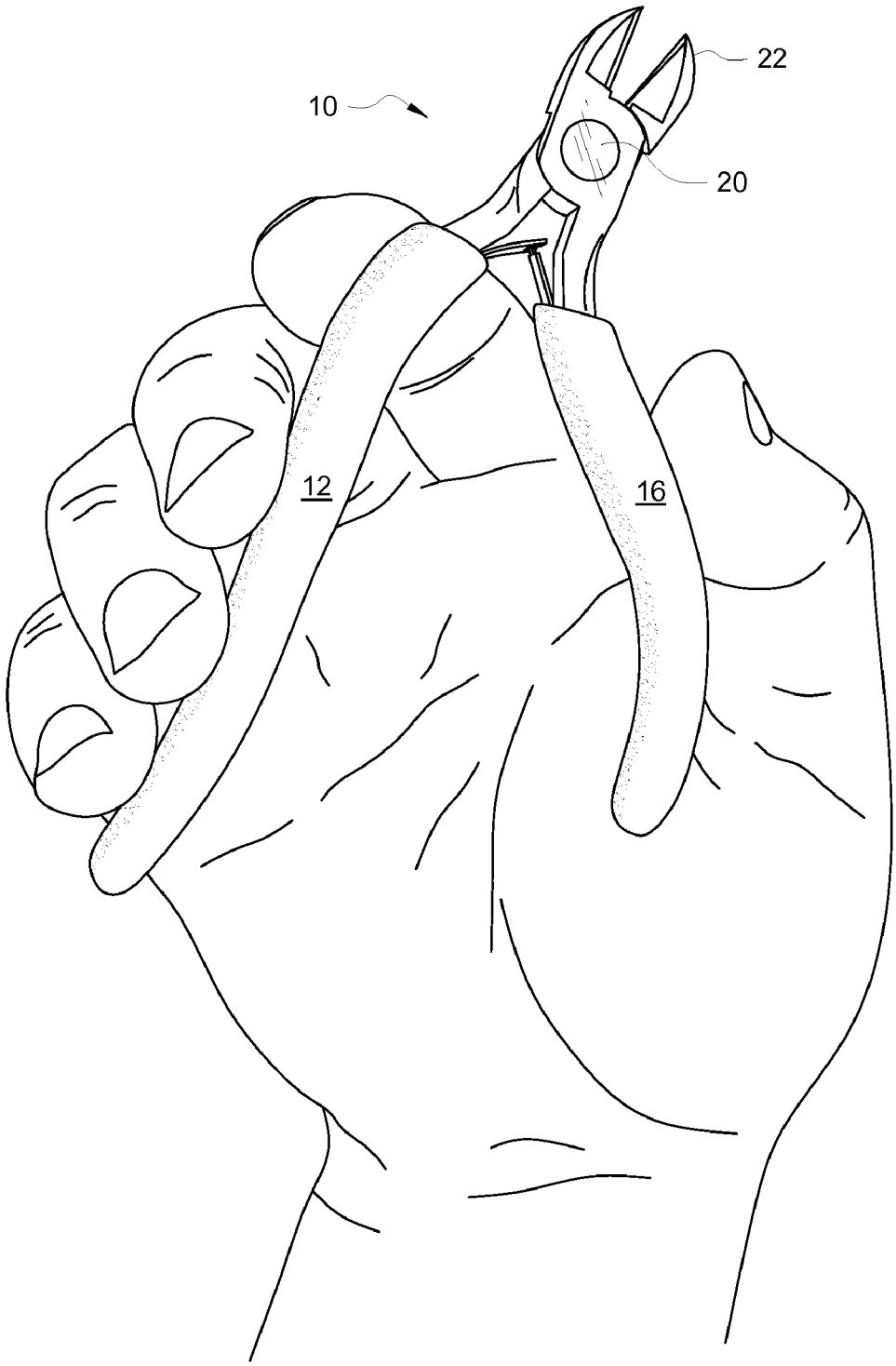
FIG. 3 is a perspective view of the novel handles when pivoted into a fully open configuration when the tool is held in a concentrated stress way.
Figure 4:
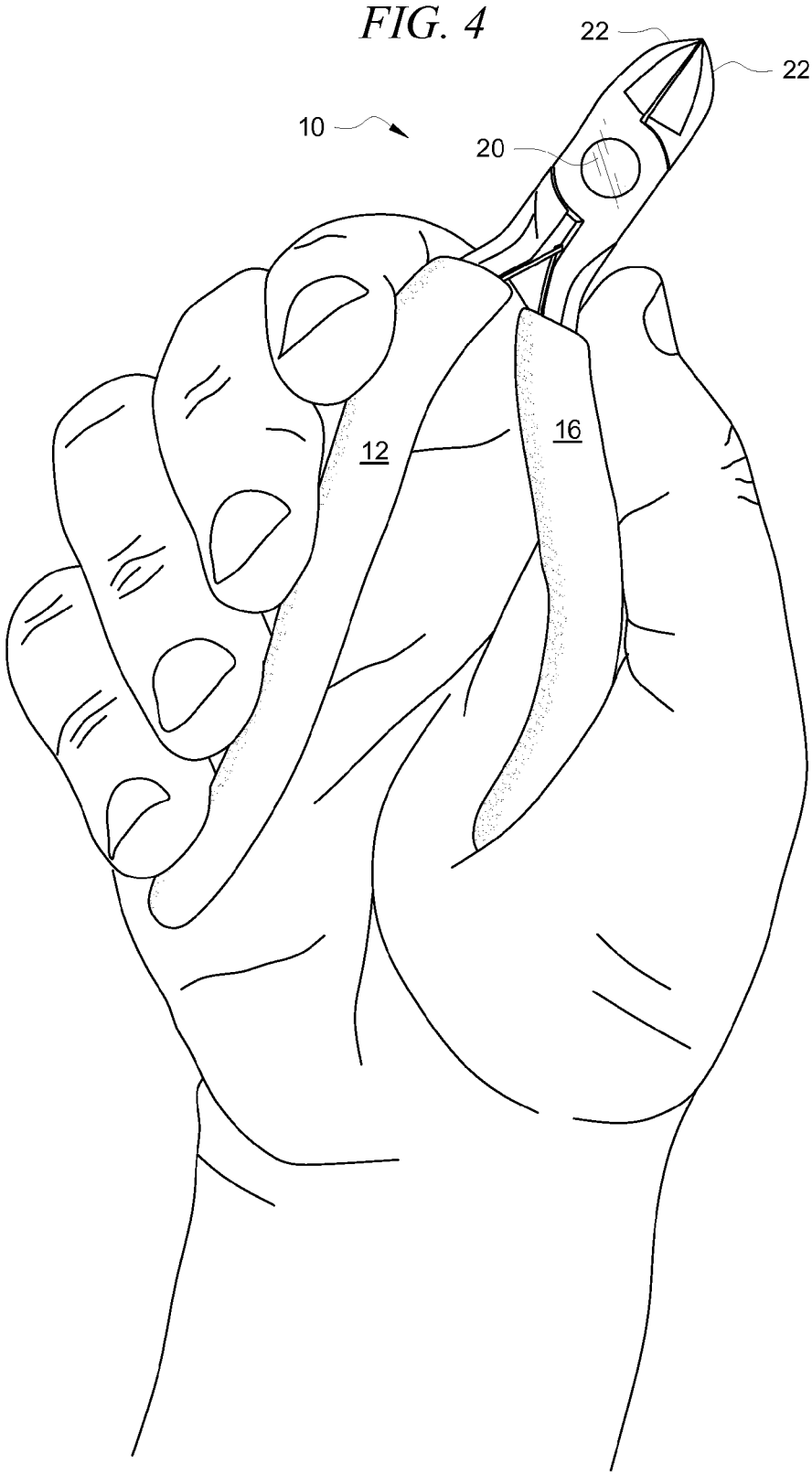
FIG. 4 is a perspective view of the handles when pivoted into a fully closed configuration when the tool is held in said concentrated stress way.

In FIGS. 3 and 4, truncate and arcuate handle 16 lies in the palm at the base of the thumb and elongate substantially straight handle 12 is grasped by the fingers of a user. As the user alternately squeezes and releases said handles, said user will eventually observe that arcuate handle 16 is applying a slightly concentrated load on the palm due to its truncate extent and straight/arcuate configuration, and that the fingers feel no such concentrated load.

Figure 5:
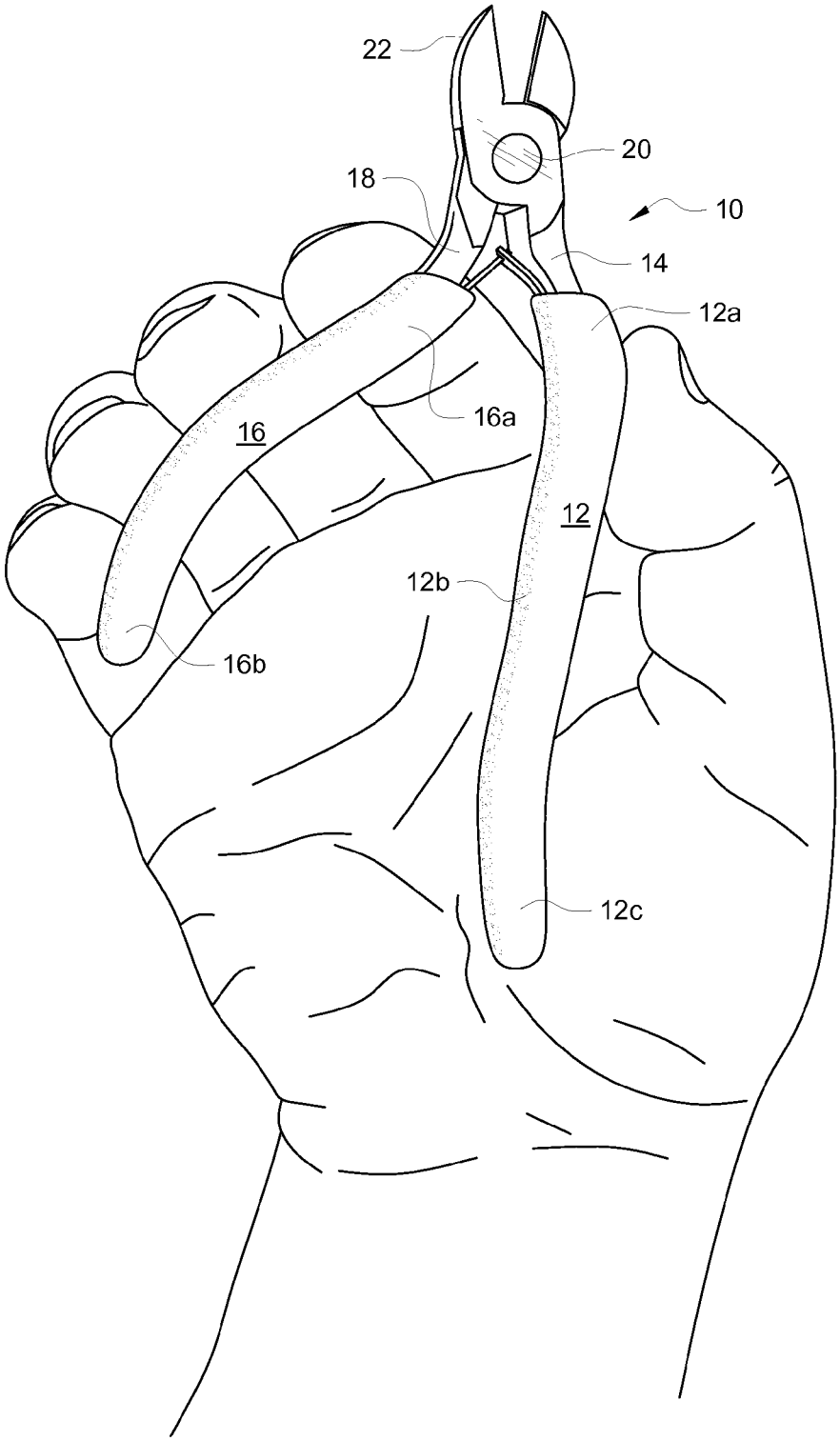
FIG. 5 is a perspective view of the novel handles when pivoted into a fully open configuration when the tool is held in a distributed stress way.
Figure 6:
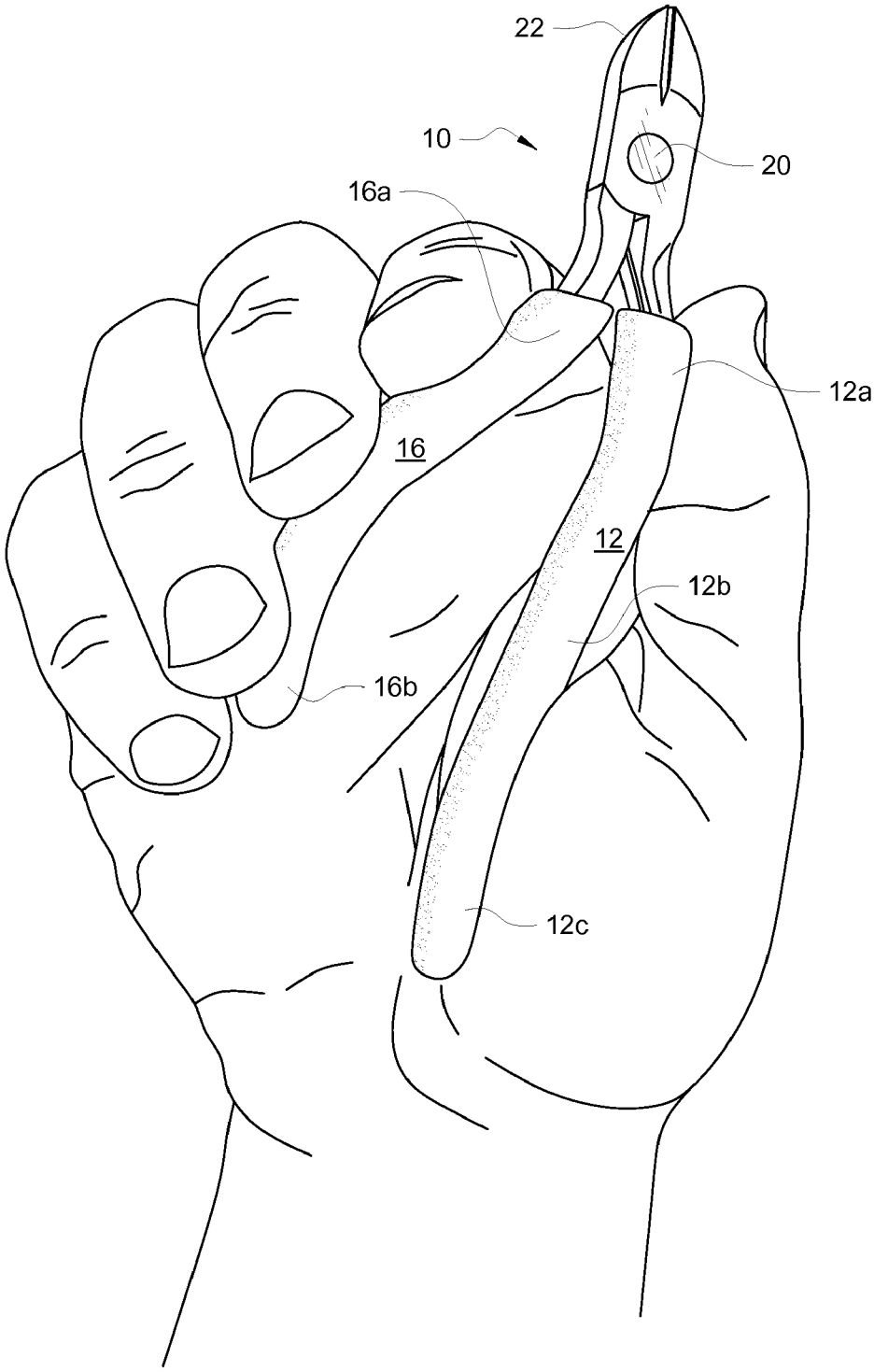
FIG. 6 is a perspective view of the novel handles when pivoted into a fully closed configuration when the tool is held in a distributed stress way.

When the concentrated load becomes uncomfortable, the user re-grips tool 10 in the manner depicted in FIGS. 5 and 6. This transfers the concentrated load to the fingers and distributes a wider load to the palm, thereby relieving the fatigue that was beginning to be felt due to the concentrated load applied to the palm. After the passage of time, the concentrated load caused by the configuration of truncate handle 16 will begin to be felt by the fingers, at which time the tool is re-gripped so that it is held as depicted in FIGS. 3 and 4. In this way, fatigue is alleviated as soon as it is felt and the user can use tool 10 for extended periods of time without fatigue.

Figure 7:
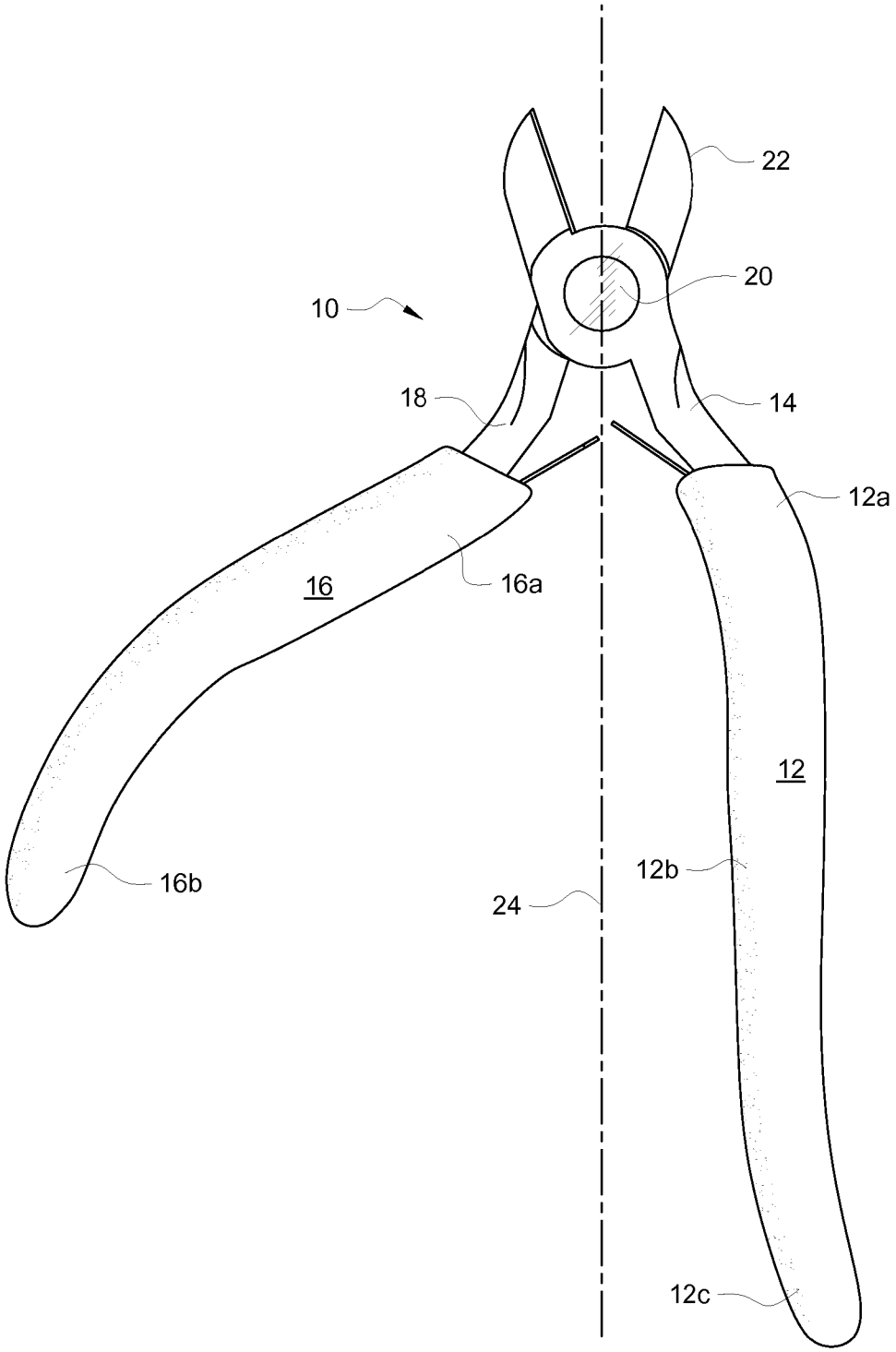
FIG. 7 is an elevational view that is horizontally flipped relative to FIG. 1.
Figure 8:
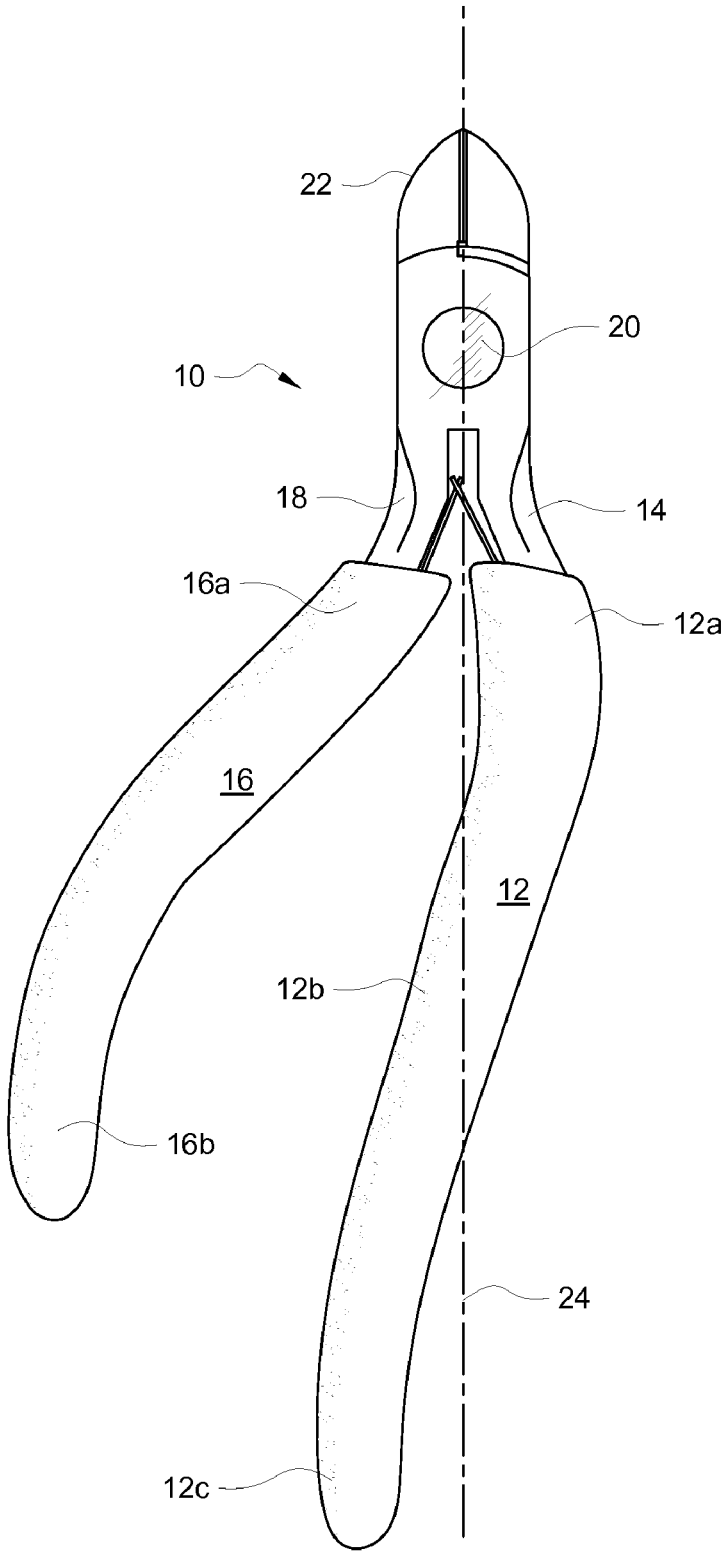
FIG. 8 is an elevational view that is horizontally flipped relative to FIG. 2.

FIGS. 7 and 8 are mirror images of FIGS. 1 and 2. Said FIGS. 7 and 8 correspond to the hand-held positions of FIGS. 5 and 6, respectively.

The preferred material for covering the metallic handles with said hollow sleeves is a spongy, cushioned polyvinyl chloride. Its chemical name is DOP (o-DIOCTYL PHTHALATE). It includes DBTM as a stabilizer, AP as a vesicant, PCL-50 chlorinated paraffin, epoxidized soybean oil as a plastifier, and zinc stearate.

The novel method includes the steps of providing a hand-held tool with a truncate, arcuate handle and an elongate, relatively straight handle, pivotally interconnecting the two handles, and alternately holding the tool in a first position where the truncate arcuate handle abuts the palm at the base of the thumb and the relatively straight handle is grasped by fingers of a user and in a second position where the relatively straight handle abuts the palm at the base of the thumb and the truncate arcuate handle is grasped by the fingers.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A hand-held tool, comprising:

a first metallic part including a first handle, a head, and a pivot point formed between said handle and head;

a second metallic part including a second handle, a head, and a pivot point formed between said handle and head;

said first and second metallic parts being pivotally interconnected to one another at their respective pivot points;

said first and second metallic parts having a fully open position and a fully closed position;

a first cushioned hollow sleeve adapted to receive said first handle therein;

a second cushioned hollow sleeve adapted to receive said second handle therein;

said first handle and said second handle having free ends disposed on a common side of a longitudinal axis of symmetry of said head that bisects said pivot point when said first and second metallic parts are in said fully closed position;

said first cushioned hollow sleeve having a truncate upper section that diverges at an angle of about ten degrees away from said longitudinal axis of symmetry of said head when said first and second metallic parts are in said fully open position;

said first cushioned hollow sleeve having an elongate, substantially straight middle section substantially parallel to said longitudinal axis of symmetry when said first and second metallic parts are in said fully open position;

said first cushioned hollow sleeve having a truncate lower section having a length substantially equal to a length of said truncate upper section, said truncate lower section diverging at an angle of about ten degrees away from said longitudinal axis of symmetry;

said upper section and said lower section of said first cushioned hollow sleeve being substantially parallel to said longitudinal axis of symmetry and said middle section of said first cushioned hollow sleeve being disposed at a slight angle to said longitudinal axis of symmetry when said first and second metallic parts are in said fully closed position;

said second cushioned hollow sleeve having a substantially straight upper section that diverges from said longitudinal axis at an angle of about forty five degrees when said first and second metallic parts are in said fully open position and that diverges from said longitudinal axis at an angle of about thirty degrees when said first and second metallic parts are in said fully closed position;

said second cushioned hollow sleeve having an arcuate lower section having a length substantially equal to the length of the upper section of said second cushioned hollow sleeve;

a gradual bend formed in said arcuate lower section, said gradual bend curving toward said longitudinal axis; and said second cushioned hollow sleeve having a length about two-thirds the length of said first hollow cushioned sleeve.

2. The hand-held tool of claim 1, further comprising:

said first and second cushioned hollow sleeves being formed of a cushioned polyvinylchloride.

* * * * *